United States Patent [19]

Pollet

[11] 4,224,396

[45] Sep. 23, 1980

[54] MAGNETIC TONER MATERIALS CONTAINING QUATERNARY AMMONIUM POLYMERS AS CHARGE CONTROL AGENTS

[75] Inventor: Jean-Claude Pollet, Rochester, N.Y.

[73] Assignee: Xerox Corporation, Stamford, Conn.

[21] Appl. No.: 882,713

[22] Filed: Mar. 2, 1978

[51] Int. Cl.[3] ..... G03G 9/14

[52] U.S. Cl. ..... 430/107; 430/115; 430/110; 428/407; 260/D20; 252/62.54

[58] Field of Search ..... 252/62.1, 62.84; 96/1 SD; 260/D20; 430/110, 109, 115; 428/407

[56] References Cited

U.S. PATENT DOCUMENTS

| | | | |
|---|---|---|---|
| 3,729,418 | 4/1973 | Machida | 252/62.1 |
| 3,960,738 | 6/1976 | O'Brien et al. | 252/62.1 |
| 3,977,983 | 8/1976 | Tsuneda | 252/62.1 |

FOREIGN PATENT DOCUMENTS

| | | | |
|---|---|---|---|
| 2702526 | 7/1977 | Fed. Rep. of Germany | 252/62.1 |

*Primary Examiner*—John D. Welsh
*Attorney, Agent, or Firm*—E. O. Palazzo

[57] ABSTRACT

Magnetic toners containing quaternary ammonium polymers, methods of their formation and utilization of such toners in various electrophotographic imaging systems are disclosed. Toners containing such compounds are suitable for use in inductive development from a biased magnetic toner brush to an electrostatic image, and further subsequently such images may be transferred preferably by electrostatic type methods to a substrate such as plain bond paper.

8 Claims, No Drawings

MAGNETIC TONER MATERIALS CONTAINING QUATERNARY AMMONIUM POLYMERS AS CHARGE CONTROL AGENTS

BACKGROUND OF THE INVENTION

This invention generally relates to the development of images particularly electrophotographic images, and more specifically to the development of images using magnetic toner particles containing quaternary ammonium polymers which materials can be used with or without employing a carrier material that is generally used in most development systems.

The development and formation of images on numerous surfaces such as for example photoconductive materials is well known with the basic xerographic process having been described in Carlson U.S. Pat. No. 2,297,691, this process involving placing a uniform electrostatic charge on a photoconductive insulating layer, exposing the layer to a light and shadow image to dissipate the charge on the areas of the layer exposed to the light, and subsequently developing the resultant latent image by depositing thereon a finely divided electroscopic material which is referred to in the art as toner. Generally this toner will be attracted to those areas of the photoconductive layer which retain a charge thus resulting in a toner image that corresponds to the electrostatic latent image. This powder image can then be transferred to a support surface such as paper, and subsequently the transferred image will be permanently affixed to the support surface by a number of known methods including fixing by heat. In these processes it is customary to use developer materials containing a toner and a carrier, one widely used system being described as cascade development which is illustrated for example in U.S. Pat. No. 3,261,855; other systems being magnetic brush development as described in U.S. Pat. No. 2,874,063, and powder cloud development as described in U.S. Pat. No. 2,221,776. In these systems the two component developer is normally employed which includes a carrier and one of the objects of the present invention is to use a toner which does not employ a carrier thereby increasing the efficiency and the quality of the development system.

Use of development systems for magnetic development without employing carrier materials has been suggested for example in Wilson U.S. Pat. No. 2,846,333, which describes the use of magnetic brush system to apply toner particles formed of ferrites and resin materials for developing electrostatic latent images. While this process performs satisfactorily in most environments, the conductivity of the toner resulted in some instances in causing the electrostatic transfer to be somewhat difficult.

Kotz, U.S. Pat. No. 3,909,258, teaches the development of magnetic images without carriers and describes an electrostatic development process employing an inductive magnetic brush without carrier. A toner useful in the magnetic development process of the Kotz patent is described in Nelson U.S. Pat. No. 3,639,245 which teaches a dry toner particle having specific electric conductivity. As indicated the Nelson patent, this type of toner can be prepared by blending magnetite with the resin and subsequently pulverizing the material to a small particle size. These particles are then mixed with conductive carbon black which is embedded in the surface of the particle, and small particles of $SiO_2$ are mixed into the toner to improve flowability. One of the problems with this type of toner, although it is sufficient for most purposes, is that it does not transfer consistently from a photoconductive substrate to plain bond paper thereby resulting in some instances in image quality of lower resolution than is normally expected.

U.S. Pat. No. 3,970,571 is also of some interest in that it teaches the use of quaternary ammonium compounds as charge control agents and indicates that the charge control agent has been found substantially more effective than the long chain quaternary ammonium surfactant materials which have previously been incorporated in toner compositions.

Accordingly, there is a need for toners, particularly magnetic toners which will be suitable for use in one component magnetic development systems, that is where a carrier is not employed, such toners also being suitable for high speed development and having acceptable electrostatic transfer characteristics for transfer from a photoconductive surface to plain bond paper. Also it is important to have a toner composition that transfers well to paper, for example which will adhere effectively by electrostatic forces in order that image disturbances will avoid blurring when the unfused image is processed prior to fixing.

In copending application U.S. Ser. No. 792,636 filed May 2, 1977 on Single Component Magnetic Toner, the subject matter of this application which is hereby incorporated totally by reference, there is disclosed a coating of magnetic pigments with fatty acid prior to mixing with the resin and spray drying to form a toner which will produce field dependent toner material. However, there continues to be a need for additional field dependent type toners. Also, in copending application, U.S. Ser. No. 854,861, filed on Nov. 25, 1977, which is fully incorporated herein by reference teaches the use of nitrogen containing additives including quaternary ammonium compounds, not polymers, in magnetic toners.

SUMMARY OF THE INVENTION

It is an object of this invention to provide a toner which overcomes the above noted disadvantages.

It is another object of this invention to provide toners that have low powder clouding systems and also which will produce sharp images by magnetic development using an inductive magnetic toner brush without carrier.

Also a further object of this invention is to provide toner compositions which are of low resistivity in order that they may be effectively used in magnetic touchdown development.

A further object of this invention is to provide toners which will transfer electrostatically from a photoreceptor to plain bond paper without causing blurring and to provide a toner whose electrical resistivity is field dependent, and further to provide superior toners for electrostatic imaging.

Other objects of the invention are to provide a toner that has better film forming properties, low resistivity especially in the low humidity range, and good toner flowability.

These and other objects of the present invention are accomplished by providing toners especially magnetic toners comprised of magnetic pigments, resin, and a quaternary ammonium polymer, or copolymer in order to provide toners of low resistivity which can develop inductively from a single component magnetic toner brush or develop well when a carrier is employed and further can also transfer electrostatically after development, obtain a higher transfer efficiency, thus more toner transfer. Toners containing the quaternary ammonium polymers of this invention allow effective good development and transfer in a bias magnetic brush system using magnetic toner with low powder clouding and excellent transfer because of the low tribo exchange with the photoreceptor. In one of the preferred embodiments of the invention the quaternary ammonium compound is located at the surface of the toner thereby allowing only a small amount, typically less than 1% by weight of the quaternary ammonium polymer to be used further providing for better efficiency.

The toner of the present invention can be prepared by a number of techniques including dispersing the quaternary ammonium polymer in a dilute solution whereby the solvent which is not a solvent for the toner is then evaporated leaving a thin more or less uniform layer of an electrically conductive polymer on a toner surface. After drying, the toner is redispersed to a powder form. The toner can also be prepared by spray drying an appropriate solvent such as water or an alcohol such as methanol or ethanol containing toner particles, and the quaternary ammonium polymer. This toner can be used to develop inductively from single component magnetic toner brush and also transfer electrostatically from the photoreceptor after development of the electrostatic latent image.

Other methods of preparation include for example those well known in the prior art including solution coating process (toner dispersion in a polymeric quaternary ammonium material, solvent evaporation, drying and redispersion in a rotating drum) in situ toner polymerization where the monomeric quaternary ammonium material is added near the end of the toner polymerization process so as to obtain a high concentration of quaternary ammonium polymer or copolymer on the toner surface, or by first coating the magnetic pigment with the quaternary ammonium polymer prior to mixing the resin.

DESCRIPTION OF THE INVENTION

The toners of the present invention generally have resistivities that are dependent on the strength of the electrical field as evidenced by the ability of these toners to electrostatically transfer without the use of specially treated papers or special transfer techniques such as pressure or the use of adhesive after inductive development from a magnetic toner brush. Thus, the toner is conductive at high fields in order to allow easy development by inductive techniques. Generally, the toners of the present invention have a resistivity of about $10^6$ to about $10^{12}$ ohm/cm. Resistivity was determined by the procedure as described herein.

The magnetic pigments used in the toners of the present invention are magnetic in that they are attracted to a magnet, however they are not necessarily magnets themselves. Generally, the toners are attracted to a magnetic brush roller or belt by a magnetic force and a charge opposite to that carrier by the photoreceptor is induced into the toner particles from the charge on the photoreceptor. Thereafter the outer particles develop into the electrostatic image as the electrostatic forces overcome the magnetic forces thus toner is deposited on the image areas. The type of forces being present in the development processes utilizing a magnetic brush system without a carrier is fully disclosed in U.S. Pat. No. 3,909,258.

Numerous magnetic pigments can be used to form the toner of the present invention as long as the particles which comprise the pigments allow the achievement of the desired magnetic and electrical properties in a toner which is to be subsequently prepared. Illustrative examples of such materials include ferrites, iron particles, and nickel alloys. The use of magnetite particles are generally preferred as they are black in color, are inexpensive, and further provide excellent magnetic properties. These particles may be of any shape or size as long as there results a semiconductive particle with acceptable transfer properties. The particle size of the pigments is generally between about 0.02 microns and about 1 micron with a preferred average particle size being 0.1 to about 0.6 microns. These particles can be of any shape including acicular or cubic.

The quaternary ammonium polymer compounds that may be useful include numerous materials generally including any of those useful in electroconductive coated paper. Illustrative examples of the preferred types of quaternary ammonium polymers used include polymers containing as functional nitrogen a quaternary on a pendant carbocyclic ring or a quaternary in an integral heterocyclic ring, especially those polymers embraced within the formula selected from the group consisting of:

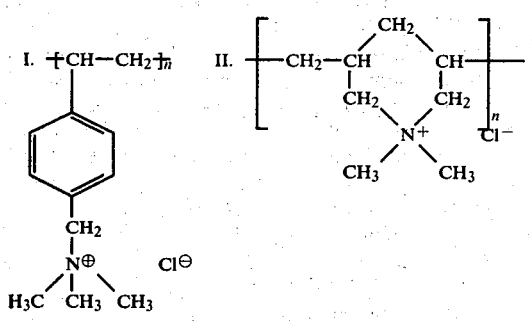

where n is a number of from about 5 to about 2500. In the above formulas the methyl groups bonded to the $N^+$ can be substituted by other alkyl groups $R_1$, $R_2$ and $R_3$ such as those containing 1–6 carbon atoms including ethyl, propyl, isopropyl, butyl, tertiary butyl and pentyl, while the $Cl^-$ can be replaced with other halogens X such as fluorine, chlorine, and iodine. Material I is commercially available from Dow Chemical Company and is fully described in U.S. Pat. Nos. 3,700,493 and 3,011,918 fully incorporated herein by reference.

Material II is fully described in U.S. Pat. Nos. 3,288,770 and 3,490,938 fully incorporated herein by reference.

Generally the materials used have a weight average molecular weight of about 2500 to 250,000 and preferably about 15,000 to 100,000.

Materials I and II are prepared as described in the above mentioned U.S. patents. For example as stated in U.S. Pat. No. 3,700,493 Material I can be prepared by dissolving a vinylaromatic monomer in a suitable inert liquid diluent. Hydrocarbons such as benzene, toluene, butane, hexane, are frequently employed with lithium and sodium alkyl catalysts. Ethers such as tetrahydrofuran, dioxane, dimethyl ether, and dimethyl glycol ether are common with sodium naphthalene and similar alkali metal polycene complex initiators. The polymerization is normally carried out with about 0.005–0.04 mole of alkali metal initiator per mole of monomer at a temperature of about −120° C. to +200° C. With styrene a temperature of about 0° to 150° C. is preferred while the α-methylstyrene preferred temperature is about 0° to 50° C. When the desired molecular weight is obtained, polymerization is terminated by addition of a chain terminating agent such as oxygen, carbon dioxide, or water. Likewise Material II can be prepared as described in U.S. Pat. No. 3,288,700 which involves a polymerization reaction and consists of dissolving in water a quaternary ammonium chloride salt monomer in which the quaternary ammonium cation is of the formulas as described in column 2, lines 1–25 of this patent such as

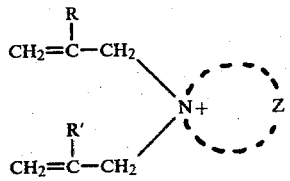

wherein R and R′ are independently selected from hydrogen chloro, bromo, or lower alkyl or phenyl radicals which can be substituted and Z is a divalent radical of the formula $$+CH_2)_p-(O)_n-(CH_2)_2-$$

wherein n is a number 0 or 1, and p is a number 2 or 3.

Other quaternary ammonium polymers can also be useful in the present invention including quaternized polyethylenimine and ionenes such as ditertiaryamine-dihalide condensates, polyvinyltrimethyl ammonium chloride and polyallyltrimethyl ammonium chloride, chloromethylated and aminated ϕ-dichloromethyl diphenyl ether condensation polymers, poly(2-hydroxy-3-methacryloyloxy propyl trimethyl ammonium chloride) and poly(N-acrylamido propyl-3-trimethyl ammonium chloride), poly(N-methylvinylpridinium chloride) and poly(N-vinyl-2,3-dimethylimidazolinium chloride), and other similar materials, containing as functional nitrogen an integral quaternary, an integral quaternary in cyclic ring, a pendant quaternary, a pendant quaternary on cyclic backbone, a pendant quaternary on acrylate backgone such as qyaternary acrylic amides, or a quaternary in pendant heterocyclic ring.

Specific examples of quaternary ammonium polymers as well as their methods of preparation that might be useful in the present invention include those described in U.S. Pat. Nos. 3,825,511; 3,674,711; 3,640,766; 3,617,372; 3,320,317; 3,486,932; 3,479,215; 3,011,918; 3,288,770; 3,700,493, fully incorporated herein by reference.

The quaternary ammonium polymer may be used in any amount that results in a toner that develops and electrostatically transfers well in a single component magnetic toner brush or in a developer system employing carrier or provides good development and efficient electrostatic transfer in a bias magnetic brush of magnetic toner and carrier. For example, the amount of quaternary ammonium polymer present ranges from about 0.01% by weight to about 10% by weight and preferably from about 0.03% by weight to about 5% by weight. Rather small amounts can be utilized just as effectively by assuring that the quaternary ammonium polymer is located at the toner surface and in these instances typically less than 1.5% by weight of quaternary ammonium polymer is sufficient although percentages varying from about 0.03% to about 5% are useful.

The toner resins which may be used with the quaternary ammonium compound of the present invention can be selected from any suitable toner resin material.

While any suitable resin may be employed in the system of the present invention, typical of such resins are polyamides, epoxies, polyurethanes, vinyl resins and polymeric esterification products of a dicarboxylic acid and a diol comprising a diphenol. Any suitable vinyl resin may be employed in the toners of the present system including homopolymers or copolymers of two or more vinyl monomers. Typical of such vinyl monomeric units include: styrene, p-chlorostyrene, vinyl naphthalene; ethylenecally unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

Generally toner resins containing a relatively high percentage of styrene are preferred since greater image definition and density is obtained with their use. The styrene resin employed may be a homopolymer of styrene or styrene homologs of copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic and cationic polymerization processes. Any of these vinyl resins may be blended with one or more other resins if desired, preferably other vinyl resins which insure good triboelectric properties and uniform resistance against physical degradation. However, non-vinyl type thermoplastic resins may also be employed including resin modified phenolformaldehyde resins, oil modified epoxy resins, polyurethane resins, cellulosic resins, polyether resins and mixtures thereof.

Polymeric esterification products of a dicarboxylic acid and a diol comprising a diphenol may also be used as a preferred resin material for the toner compositions of the instant invention. The diphenol reactant has the general formula:

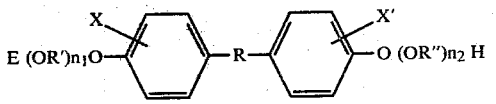

wherein R represents substituted and unsubstituted alkylene radicals having from 2 to 12 carbon atoms, alkylidene radicals having from 1 to 12 carbon atoms and cycloalkylidene radicals having from 3 to 12 carbon atoms; R′ and R″ represent substituted and unsubstituted alkylene radicals having from 2 to 12 carbon atoms, alkylene arylene radicals having from 8 to 12 carbon atoms and arylene radicals; X and X′ represents hydrogen or an alkyl radical having from 1 to 4 carbon atoms; and $n_1$ and $n_2$ are each at least 1 and the average sum of $n_1$ and $n_2$ is less than 21. Diphenols wherein R represents an alkylidene radical having from 2 to 4 carbon atoms and R′ and R″ represents an alkylene radical having from 3 to 4 carbon atoms are preferred because greater blocking resistance, increased definition of xerographic characters and more complete transfer of toner images are achieved. Optimum results are obtained with diols in which R′ is an isopropylidene radical and R′ and R″ are selected from the group consisting of propylene and butylene radicals because the resins formed from these diols possess higher agglomeration resistance and penetrate extremely rapidly into paper receiving sheets under fusing conditions. Dicarboxylic acids having from 3 to 5 carbon atoms are preferred because the resulting toner resin possess greater resistance to film formation on reusable imaging surfaces and resist the formation of fines under machine operation conditions. Preferred results are obtained with alpha unsaturated dicarboxylic acids including fumaric acid, maleic acid or maleic acid anhydride because maximum resistance to physical degradation of the toner as well as rapid melting properties are achieved. Any suitable diphenol which satisfies the above formula may be employed. Typical such diphenols include: 2,2-bis(4-beta hydroxy ethoxy phenyl)-propane, 2,2-bis(4-hydroxy isopropoxy phenyl) propane, 2,2-bis(4-beta hydroxy ethoxy phenyl) pentane, 2,2-bis(4-beta hydroxy ethoxy phenyl)-butane, 2,2-bis(4-hydroxy-propoxy-phenyl)-propane, 2,2-bis(4-hydroxy-propoxy-phenyl) propane, 1,10bis(4-hydroxy-ethoxy-phenyl)-butane, 1,1-bis(4-hydroxy isopropoxy-phenyl) heptane, 2,2-bis(3-methyl-4-beta-hydroxy ethoxy-phenyl) propane, 1,1-bis(4-beta hydroxy ethoxy phenyl)-cyclohexane, 2,2′-bis(4-beta hydroxy ethoxy phenyl)-norbornane, 2,2′-bis(4-beta hydroxy ethcxy phenyl) norbornane, 2,2-bis(4-beta hydroxy styryl oxyphenyl) propane, the polyoxyethylene ether of isopropylidene diphenol in which both phenolic hydroxyl groups are oxyethylated and the average number of oxyethylene groups per mole is 2.6, the polyoxypropylene ether of 2-butylidene diphenol in which both the phenolic hydroxy groups are oxyalkylated and the average number of oxypropylene groups per mole is 2.5, and the like. Diphenols wherein R represents in alkylidene radical having from 2 to 4 carbon atoms and R′ and R″ represent an alkylene radical having from 3 to 4 carbon atoms are preferred because greater blocking resistance, increased definition of xerographic characters and more complete transfer of toner images are achieved. Optimum results are obtained with diols in which R is isopropylidene and R′ and R″ are selected from the group consisting of propylene and butylene because the resins formed from these diols possess higher agglomeration resistance and penetrate extremely rapidly into paper receiving sheets under fusing conditions.

Any suitable dicarboxylic acid may be reacted with a diol as described above to form the toner compositions of this invention either substituted or unsubstituted, saturated or unsaturated, having the general formula:

$$HOOC\ R'''_{n_3}COOH$$

wherein R‴ represents a substituted or unsubstituted alkylene radical having from 1 to 12 carbon atoms, arylene radicals or alkylene arylene radicals having from 10 to 12 carbon atoms and $n_3$ is less than 2. Typical such dicarboxylic acids including their existing anhydrides are: oxalic acid, malonic acid, succinic acid, glutaric acid, adipic acid, pimelic acid, suberic acid, azelaic acid, sebacic acid, phthalic acid, mesaconic acid, homophthalic acid, isophthalic acid, terephthalic acid, o-phenyleneacetic-beta-propionic acid, itaconic acid, maleic acid, maleic acid anhydride, fumaric acid, phthalic acid anhydride, traumatic acid, citraconic acid, and the like. Dicarboxylic acids having from 3 to 5 carbon atoms are preferred because the resulting toner resins possess greater resistance to film formation on reusable imaging surfaces and resist and formation of fines under machine operation conditions. Optimum results are obtained with alpha unsaturated dicarboxylic acids including fumaric acid, maleic acid, or maleic acid anhydride as maximum resistance to physical degradation of the toner as well as rapid melting properties are achieved. The polymerization esterification products may themselves be copolymerized or blended with one or more other thermoplastic resins, preferably aromatic resins, aliphatic resins, or mixtures thereof. Typical thermoplastic resins include: resin modified phenolformaldehyde resin, oil modified epoxy resins, polyurethane resins, cellulosic resins, vinyl type resins and mixtures thereof. When the resin component of the toner contains an added resin, the added component should be present in an amount less than about 50 percent by weight based on the total weight of the resin present in the toner. A relatively high percentage of the polymeric diol and dicarboxylic acid condensation product in the resinous component of the toner is preferred because a greater reduction of fusing temperatures is achieved with a given quantity of additive material. Further, sharper images and denser images are obtained when a high percentage of the polymeric diol and dicarboxylic acid condensation product is present in the toner. Any suitable blending technique may be employed to incorporate the added resin into the toner mixture. The resulting resin blend is substantially homogeneous and highly compatible with pigments and dyes. Where suitable, the colorant may be added prior to, simultaneously with or subsequent to the blending of polymerization step.

Optimum electrophotographic results are achieved with styrene-butyl methacrylate copolymers, styrene-vinyltoluene copolymers, styrene-acrylate copolymers, polystyrene resins, predominately styrene or polystyrene based resins as generally described in U.S. Pat. No. Re. 25,136 to Carlson and polystyrene blends as described in U.S. Pat. No. 2,788,288 to Rheinfrank and Jones.

The solvent used for spray drying may be any material capable of dissolving the toner resin and the additive without adversely effecting the additive or the magnetite. Solvents for toner resins are well known and include hydrocarbons, alcohols, ketones, esters, amides, fluorinated hydrocarbons, chlorinated hydrocarbons and other well known solvents. Preferred solvents are toluene for use with styrene polymer blends as this results in a toner that is solvent free and the solvent is low cost and relatively non-flammable. Chloroform has been found to be a preferred solvent for use with polyester type toner resins as it is readily available, non-flammable and results in a toner of low residual solvent. Both chloroform and toluene also are compatible with the preferred phosphate. The solvent is generally used in an amount such that the solids content of the solvent slurry is 5-20% by weight. The term solids content is used here to indicate the solid resulting from spray drying which is the resin, phosphorous additive and magnetite plus any other additives to the toner such as colorants or triboelectric regulators.

The addition of additives to the solvent prior to spray drying for inclusion in the toner are embraced by the present invention. Additives such as dyes, pigments, dispersing agents, humidity sensitivity control materials may be added prior to toner formation. Suitable black colorants are carbon black pigments and nigrosine dyes. The preferred magnetite materials of the instant process are black and therefore suitable for the majority of electrophotographic reproduction uses without benefit of colorant additives. However, other less dark colored magnetic materials might require pigment or dye additives to obtain a suitable toner color. Such pigments and dyes while useful are generally not needed to obtain a suitable toner color, or needed to obtain field dependency of the toners.

When carrier materials are employed in connection with the toner compositions of the present invention such as in cascade and magnetic brush development, the carrier particles employed may be electrically conductive, insulating, magnetic or nonmagnetic, as long as the carrier particles are capable of triboelectrically obtaining a charge of opposite polarity to that of the toner particles so that the toner particles adhere to and surrond the carrier particles. In developing a positive reproduction of an electrostatic image, the carrier particle is selected so that the toner particles acquire a charge having a polarity opposite to that of the electrostatic latent image so that toner deposition occurs in image areas. Alternatively, in reversal reproduction of an electrostatic latent image, the carriers are selected so that the toner particles acquire a charge having the same polarity as that of the electrostatic latent image resulting in toner deposition in the non-image areas. Typical carrier materials include: sodium chloride, ammonium chloride, aluminum potassium chloride, Rochelle salt, sodium nitrate, aluminum nitrate, potassium chlorate, granular zircon, granular silicon, methyl methacrylate, glass, steel, flint shot, nickel, iron, ferrites, ferromagnetic materials, metal oxides, silicon dioxide and the like. The carriers may be employed with or without a coating. Many of the foregoing and typical carriers are described by L. E. Walkup in U.S. Pat. No. 2,618,551; L. E. Walkup et al in U.S. Pat. No. 2,638,416; E. N. Wise in U.S. Pat. No. 2,618,552; R. H. Hagenbach et al in U.S. Pat. Nos. 3,591,503 and 3,533,835 directed to electrically conductive carrier coatings, and B. J. Jacknow et al in U.S. Pat. No. 3,526,533 directed to methyl terpolymer coated carriers which are the reaction products of organo silanes, silanols or siloxanes with unsaturated polymerizable organic compounds (optimum among those disclosed are terpolymer coatings achieved with a terpolymer formed from the addition polymerization reaction between monomers or prepolymers of: styrene, methylmethacrylate and unsaturated organo silanes, silanols or siloxanes; and nickel berry carriers as disclosed in U.S. Pat. Nos. 3,847,604 and 3,767,598. Nickel berry carriers are modular carrier beads of nickel characterized by a surface of recurring recesses and protrusions giving the particles a relatively large external surface area. An ultimate coated carrier particle diameter between about 50 microns to about 1000 microns is preferred because the carrier particles then possess sufficient density and inertia to avoid adherence to the electrostatic images during the cascade development process. The carrier may be employed with the toner composition in any suitable combination, generally satisfactory results have been obtained when about 1 part toner is used with about 10 to about 200 parts by weight of carrier.

The toners of the instant invention also may be utilized in systems such as powder cloud develoment which do not require any carrier.

Any suitable pigment or dye can be utilized as the colorant for the toner particles such colorants including for example carbon black, magnetite, nigrosine dye, aniline blue, Calco Oil Blue, chrome yellow, ultramarine blue, duPont oil red, methylene blue chloride, phthalocyanine blue, lamp black and mixtues thereof. The pigment or dyes are generally present in the toner in a quantity sufficient to render the toner highly colored in order that it will form a visible image on the recording member. The pigment is generally employed in amounts from about 1 percent to about 30 percent by weight based on the total weight of colored toner. When a dye is used as a toner colorant substantially smaller quantities of the colorant may be used.

The toner compositions of the present invention can be prepared by well known techniques including toner mixing and comminution techniques. For example, the various ingredients can be thoroughly mixed by blending, milling and mixing the components and thereafter micropulverizing the resulting mixture. Another technique involves spray drying a ball milled toner composition comprising a colorant, a resin, and a solvent. As indicated herein the additive and toner are mixed using any suitable mixing method such as roll mixing, shaking, or twin shell blending, such additive being an external additives for the toner.

The toner compositions for the present invention can be used to develop electrostatic latent images on any suitable electrostatic latent image bearing surface including conventional photoconductive surfaces. Photoconductive materials are well known in the art and include for example vitreous selenium, organic or inorganic photoconductors embedded in a non-photoconductive matrix, organic or inorganic photoconductors embedded in a photoconductive matrix or the like. Representative patents in which such photoconductive materials are described include for example U.S. Pat. Nos. 2,803,542; 2,970,906 and 3,121,006. Typical photoconductors include sulfur, selenium, zinc sulfide, zinc oxide, zinc cadmium sulfide, zinc magnesium oxide, cadmium selenide, zinc silicate, calcium strontium sulfide, cadmium sulfide, 4-dimethylaminobenzylidene benzhydrazide; 3-benzylidene-aminocarbazole; polyvinyl carbazole; (2-nitro-benzylidene)-p-bromoaniline; 2,4-diphenyl-quinazoline; 1,2,4-triazine; 1,5-diphenyl-3-methyl pyrazoline 2-(4'-dimethyl-amino phenyl)-benzoxazole; 3-amino-carbazole; polyvinylcarbazole-trinitrofluorenone charge transfer complex; phthalocyanines and mixtures thereof.

Examples of systems which can be used for removing residual toner particles from the surface of imaging members such as photoreceptors include brush cleaning and web cleaning as described in U.S. Pat. Nos. 2,832,977 and 3,186,838. Additionally, blade cleaning systems using doctor or wiping blades made from a wide variety of filled or unfilled natural and synthetic materials can be used. Generally, flexible blades comprising elastomeric materials such as polyurethane are preferred since removal of residual toner particles from the reusable photoreceptor surface seems to be more effective when such materials are employed. Other elastomeric materials include natural rubber, synthetic rubbers such as neoprene and plasticized polyvinyl chloride.

The following examples further define and describe and contain comparative results regarding the preparation of the developers for use in the present invention. Parts and percentages are by weight unless otherwise indicated. These examples other than the control examples are intended to illustrate the various preferred embodiments of the present invention.

EXAMPLE I

There was prepared a slurry toner solution by dispersing a toner in a dilute solution of the quaternary ammonium polymer, polyvinyl benzyl trimethyl ammonium chloride, (commercially available in an aqueous solution containing about 33% solids from Dow Chemical Company). In accordance with the present Example, 100 parts of a magnetic toner, comprised of 40 percent of a copolymer of styrene and n-butylmethacrylate, 50 percent magnetite, (K-378, submicron particle size magnetite commercially available from Northern Pigments, Toronto, Canada), and 10 percent of Vulcan, (a carbon black commercially available from Cabot Corporation) is dispersed in a solution of 80 parts of deionized water, and 0.2 parts of the commercially available solution of polyvinyl benzyl trimethyl ammonium quaternary ammonium polymer. Stirring of this mixture was accomplished in order to obtain a good wetting of the toner. Subsequently the toner slurry material was poured into a tray, and any water present was evaporated by blowing air over the tray, the material being stirred from time to time during evaporation. After drying overnight at room atmosphere the toner containing the quaternary ammonium polymer described above was easily dispersed to a powder. This toner was further dried for about 12 hours, over the drying agent Drierite, commercially available from DuPont and the resulting material easily passed through a 44 micron sieve, indicating good redispersion to a powder.

A solid surface area developed with the above prepared toner (no carrier being present) resulted in full development of excellent quality and excellent adhesion while a solid area developed with the above toner (as a control) but containing no quaternary ammonium polymeric additive resulted in substantially no development whatsoever.

EXAMPLE II

The procedure of Example I was repeated with the exception that in place of the quaternary ammonium polymer polyvinyl benzyl trimethyl ammonium chloride, there is used the quaternary ammonium polymer poly(N,N-dimethyl-3,5-methylene piperidinium chloride) and substantially the same results are observed with the toner containing the ammonium polymer of this example, as compared to substantially no development with the toner containing no ammonium polymer of this example.

EXAMPLE III

A. The same toner in Example I is utilized, that is, 40% of a copolymer of styrene and n-butyl methacrylate, 50% magnetite, (K-378, submicron particle size magnetite commercially available from Northern Pigments, Toronto, Canada), and 10% of Vulcan, (a carbon black commercially available from Cabot Corporation). This untreated toner 100 parts was coated with 1.2 parts of the quaternary ammonium polymer polyvinyl benzyl trimethyl ammonium chloride, (commercially available from Dow Chemical Company) by spray drying the untreated toner in a water solution of the quaternary ammonium polymer polyvinyl benzyl trimethyl ammonium chloride, (commercially available from Dow Chemical Company).

B. The untreated toner compound 100 parts of 40% of a polystyrene resin Piccolastic D/125, commercially available from Hercules Chemical Company, 52% of magnetite (K-378 submicron particle size magnetite commercially available from Northern Pigments, Toronto, Canada) and 8% of Vulcan (a carbon black commercially available from Cabot Corporation) was coated with 1 part of the quaternary ammonium polymer solution polyvinyl benzyl trimethyl ammonium chloride, (commercially available from Dow Chemical Company) by spray drying the untreated toner in a water solution of the polymer.

Image developed with the treated toner containing the specific quaternary ammonium compound of this Example showed complete excellent development of high quality while image developed with the untreated toner were incomplete and of very low quality.

EXAMPLE IV

The toner of Example I is utilized in a biased magnetic brush developer with a steel carrier. The loading is about 3 parts toner to 100 parts carrier. Development onto electrostatic image carried by a photoreceptor is clear and sharp. Electrostatic transfer is effective. Visual observation is that the powder clouding of the toner and the developer housing is less than normal.

The resistivity measurements for toner are determined by the following process. Measurements on powder are complicated by the fact that the results are influenced by characteristics of the powder particles, shape and size in addition to powder composition. Therefore, measurements were obtained on powder rather than by molding the powder into a pellet specimen in order to better relate the properties to the toner behavior in development. The measurements were made using a two inch diameter electrode of a Balsbaugh cell for measuring the direct current resistivity of the toner. The gap distance is 0.05 inch. The toner is packed between the electrodes of the cell by vibration until a constant bed volume is reached. The current is measured as a function of applied voltage at the 40 mil gap. The electrification time is 1 minute as recommended by ASTM method, ASTM Designation D-257-66 (Reapproved 1972). After each measurement the sample is repacked by vibration. Resistivity is calculated according to Ohms law.

Although specific materials and conditions were set forth in the above exemplary processes in the formation and using the toner of the invention these are merely intended as illustrations of the present invention. Various other substituents and processes such as those listed above may be substituted for those in the examples with similar results. In addition to the steps used in formation of the toner of the present invention other steps or modifications may be used. For instance the pigment could be classified or separated by other filtering methods. In addition other materials such as colorants could be added.

The magnetic pigment of the invention may be utilized in any amount that forms a magnetic field dependent toner. A suitable range has been found to be a magnetic pigment content between about 40 and about 70 weight percent of magnetic particles in the finished toner. A preferred range is a magnetite content between about 45 and 55 weight percent of magnetite for good magnetic development properties and good transfer.

Other modifications of the present invention will occur to those skilled in the art upon reading of the present disclosure. These are intended to be included within the scope of this invention. For instance, the magnetic toner particles of this invention could be utilized in the formation of permanent magnets or in a paint as a magnetic coating. Further the method could be used to treat colored pigments for toner use to replace humidity sensitivity.

What is claimed is:

1. A field dependent toner of low resistivity for use in an electrophotographic imaging system, the toner being comprised of resin, magnetic pigment, and from between about 0.01 percent by weight and about 10 percent by weight of the toner of a quaternary ammonium polymer having a resistivity of from about $10^6$ to $10^{12}$ ohm/cm, this polymer being selected from the group consisting of those polymers of the following formula:

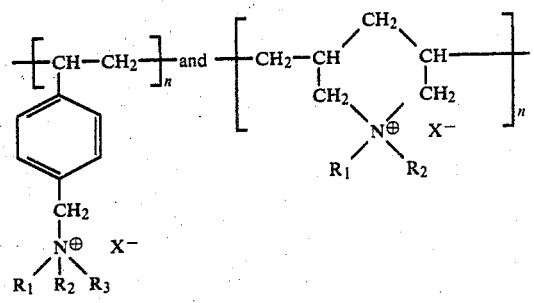

wherein n is a number of from about 5 to about 2500, $R_1$, $R_2$ and $R_3$ are independently selected from alkyl radicals, and x is a halogen, thereby resulting in full development of the image formed in the electrophotographic imaging process and substantially complete transfer of the toner particles to a substrate.

2. An electrophotographic toner in accordance with claim 1 wherein $R_1$, $R_2$ and $R_3$ are methyl radicals and X is chloride.

3. An electrophotographic toner in accordance with claim 1 wherein the quaternary ammonium polymer is a vinyl benzyl trimethyl ammonium chloride polymer.

4. An electrophotographic toner in accordance with claim 1 wherein the quaternary ammonium polymer is a N,N-dimethyl-3,5-methylene piperidinium chloride polymer.

5. An electrophotographic toner in accordance with claim 1 wherein the quaternary ammonium polymer is present at the surface of the toner in an amount of between about 0.03 and about 5% by weight of toner.

6. An electrophotographic toner in accordance with claim 1 wherein the magnetic pigment comprises between about 40% to about 70% by weight of the toner.

7. An electrophotographic toner in accordance with claim 1 wherein the magnetic toner comprises magnetite.

8. An electrophotographic toner in accordance with claim 1 wherein the toner resin is a compound of a copolymer of styrene and butyl methacrylate.

* * * * *